US005873219A

United States Patent [19]

Storti

[11] Patent Number: 5,873,219

[45] Date of Patent: Feb. 23, 1999

[54] AUTOMATIC FILING DEVICE FOR PHOTOS PRINTS AND SIMILAR MATERIALS

[75] Inventor: Fabrizio Storti, Recoaro Terme, Italy

[73] Assignee: Siral S.r.l., Valdagno, Italy

[21] Appl. No.: 936,927

[22] Filed: Sep. 25, 1997

[30] Foreign Application Priority Data

Sep. 27, 1996 [IT] Italy ..... VI96 A0151

[51] Int. Cl.[6] ..... B65B 35/36

[52] U.S. Cl. ..... 53/446; 53/284.2; 53/568

[58] Field of Search ..... 53/284.2, 446, 53/447, 540, 544, 254, 553, 568–70, 252; 414/797, 796.4; 271/11, 14, 102, 267; 206/455; 294/64.1

[56] References Cited

U.S. PATENT DOCUMENTS

| | | | |
|---|---|---|---|
| 4,004,340 | 1/1977 | Urban | 29/417 |
| 4,139,978 | 2/1979 | Jensen | 53/167 |
| 4,519,185 | 5/1985 | Horn | 53/550 |
| 4,551,966 | 11/1985 | Aoyagi | 53/571 |
| 5,076,038 | 12/1991 | Costa | 53/266.1 |
| 5,187,917 | 2/1993 | Mykleby | 53/434 |
| 5,467,577 | 11/1995 | Sato | 53/468 |
| 5,653,575 | 8/1997 | Park | 414/797 |

FOREIGN PATENT DOCUMENTS

| | | | |
|---|---|---|---|
| WO 92/15044 | 9/1992 | WIPO | 53/284.2 |

*Primary Examiner*—Daniel B. Moon
*Assistant Examiner*—James P. Calve
*Attorney, Agent, or Firm*—Bucknam and Archer

[57] ABSTRACT

An automatic filing device for photos, prints and other similar materials for inserting pairs of photos arranged back-to-back into envelopes. The insertion is carried out by means of a rotating shelf (5) on which the photos are placed and a pusher (7) which slides them into the envelopes. The method of insertion is also described.

6 Claims, 5 Drawing Sheets

AUTOMATIC FILING DEVICE FOR PHOTOS PRINTS AND SIMILAR MATERIALS

FIELD OF THE INVENTION

This invention relates to a device for simultaneously inserting into an envelope having two overlaying pockets two photos, prints or the like, the photos being placed back-to-back but not touching each other and with each image turned 180° with respect to the other.

BACKGROUND OF THE PRIOR ART

It has been known for some time that photo shops supply to customers, together with the negatives and the developed photos, folders similar to a booklet, for the purpose of containing the above-mentioned photos.

The step of inserting the photos into said folders is done manually by the customer.

At present, in fact, there is no equipment on the market that is capable of sufficiently carrying out the operation of automatic mechanical insertion, or that, when installed in photo shops or directly in developing and printing laboratories, makes it possible for the customer to receive not loose photos but photos already inserted into a folder in the exact order in which they were on the roll of film.

With such a solution, one could eliminate the danger of deterioration of the photos caused by handling during the transportation from the developing laboratory to the photo shop, and above all, damage caused by the customer when manually inserting the photos. This operation is complicated by the difficulties in separating the edges of the envelopes, which tend to stick to each other due to an electrostatic charge.

SUMMARY OF THE INVENTION

The object of this invention is to provide an apparatus capable of automatically inserting pairs of photos, prints and similar materials (hereinafter generically referred to as "photos"), arranged back-to-back though not in direct contact, inside double-pocketed envelopes, the apparatus being easily constructed, easy to use, compact, and allowing high-speed production.

The apparatus must be formed in such a manner as to be conveniently installed in the photo shops which hand out the photos, as well as in developing and printing laboratories, in line downstream of the other apparatuses in operation.

This can be realized by providing an apparatus hereafter referred to as photopacker, that basically consists of the following structures: an input storage area for the photos which are arranged in stacks, with the back facing downwards, or which come directly from the developing apparatus; a structure that takes a single photo at a time from the storage area for the formation of the successive pairs of photos, arranged back-to-back; a pusher which inserts each pair of photos into a corresponding double-pocketed envelope; and finally an input group for the envelopes which contain the above-mentioned photos.

One of the novel characteristic features of this invention is the process for forming the pairs of photos, inserted into two independent pockets, overlaying back-to-back but not touching, with the images turned 180° with respect to each other.

In actual operation, the process starts when a suction-cup group takes the first photo from the storage area and places it on the upper surface of a rotating shelf.

The rotating shelf conveniently rotates on its longitudinal axis and after the suction cups have placed the first photo on the upper surface of the rotating shelf, the latter turns 180° in order to present the other surface upward, ready to receive a second photo.

With this operation, the first photo is positioned downwards on the rotating shelf, and the picture or image ends up turned 180° with respect to its initial position.

In succession, the suction-cup group takes a second photo from the storage area and places it on the free surface of the rotating shelf.

Next, at the end of every two loads onto the rotating shelf, two photos are allocated, obviously separated by the thickness of the plate that makes up the above-mentioned rotating shelf and arranged back-to-back with the images mutually turned 180°.

Then, a pusher slides the photos from the rotating shelf and inserts the two photos simultaneously, arranged as described, into two corresponding independent pockets which form an envelope facing the above-mentioned rotating shelf, so as to complete the insertion operation.

At the end of the insertion operation, a continuous band on which the double-pocketed envelopes are formed is moved forward one unit so that the envelope containing the two photos is moved away from the working area and the next empty envelope is placed in front of the rotating shelf for the insertion of the following pairs of photos, also arranged in the same back-to-back manner.

At the end of the cycle, a cutter separates the envelopes, each with a pair of photos, one by one or as a continuous series, from the rest of the band with the envelopes which are still empty.

The separate envelopes, once stacked following the order in which they were inserted and thanks to this mutual 180° turn in which the images of each photo are found, thus allow the creation of booklets or folders, where the photos are arranged in the same order as on the roll of photographic film.

BRIEF DESCRIPTION OF THE DRAWINGS

These and other features of this invention are further illustrated by the description of a possible form of construction, which is intended only as an illustrative example and not limiting the invention to this description, by reference to the figures in which.

Figures 1, 2:
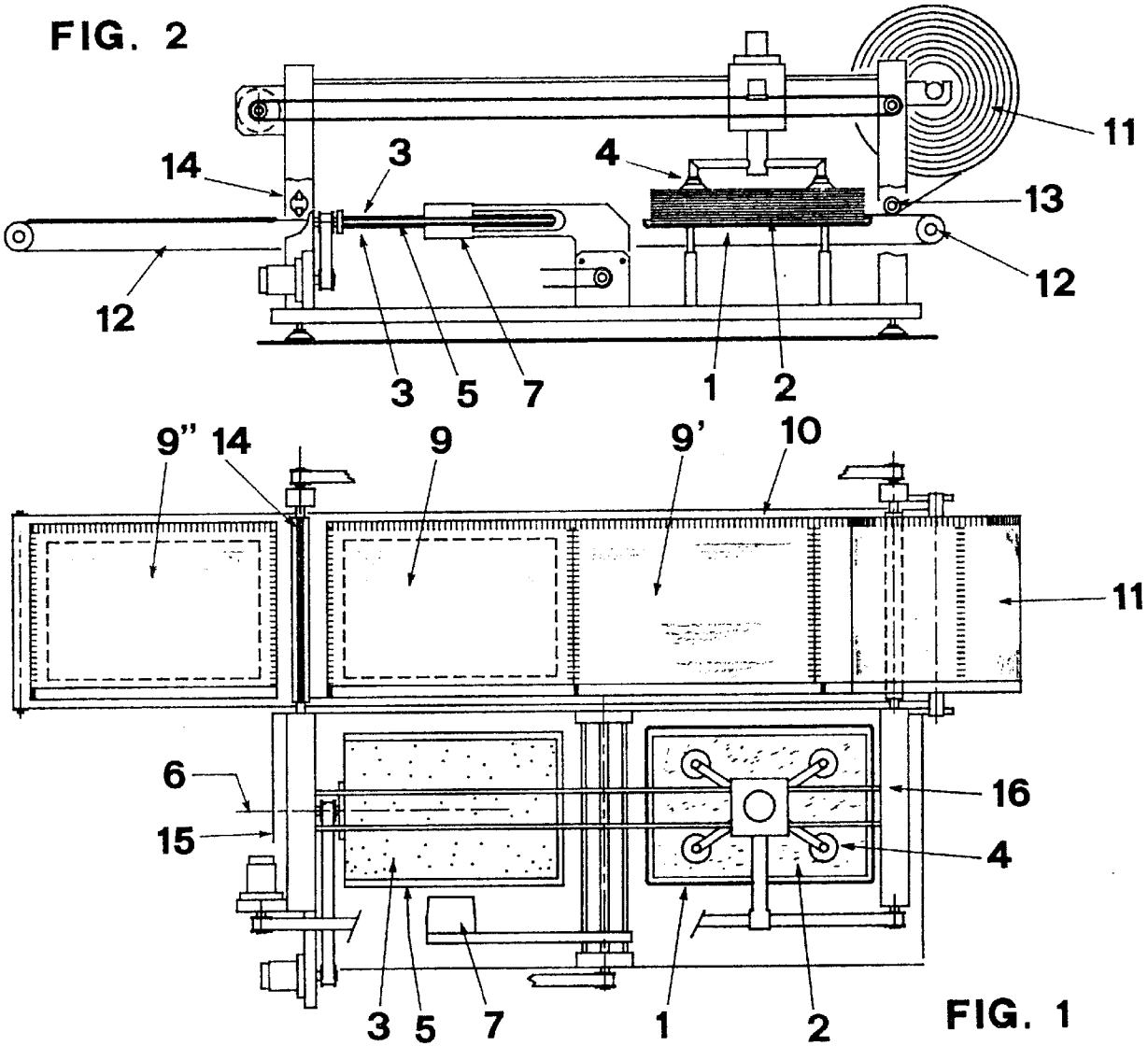
FIG. 1 schematically shows a top view of the equipment of this invention during the working cycle.
FIG. 2 is a side view of the equipment of FIG. 1.
Figure 5:
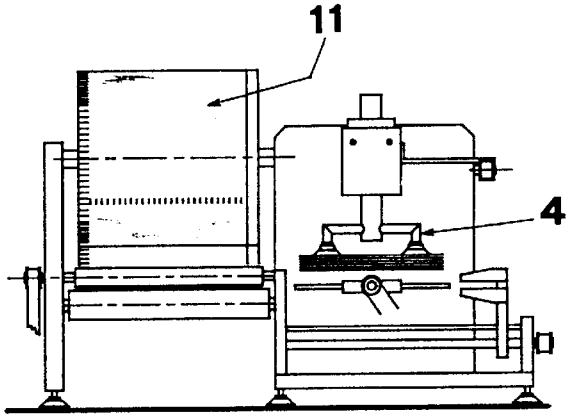
FIG. 5 is a cross-sectional view of the equipment of FIG. 3 according to the line V—V of FIG. 4.
Figure 4:
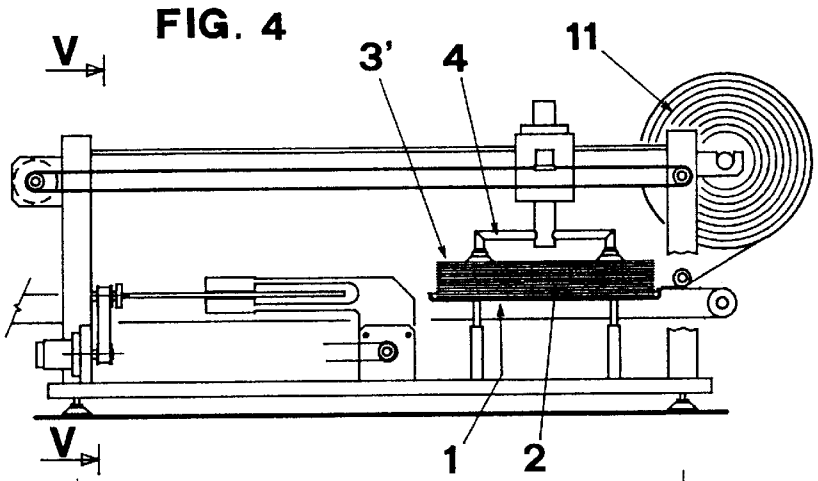
FIG. 4 is a side view of the equipment of FIG. 3.
Figure 3:
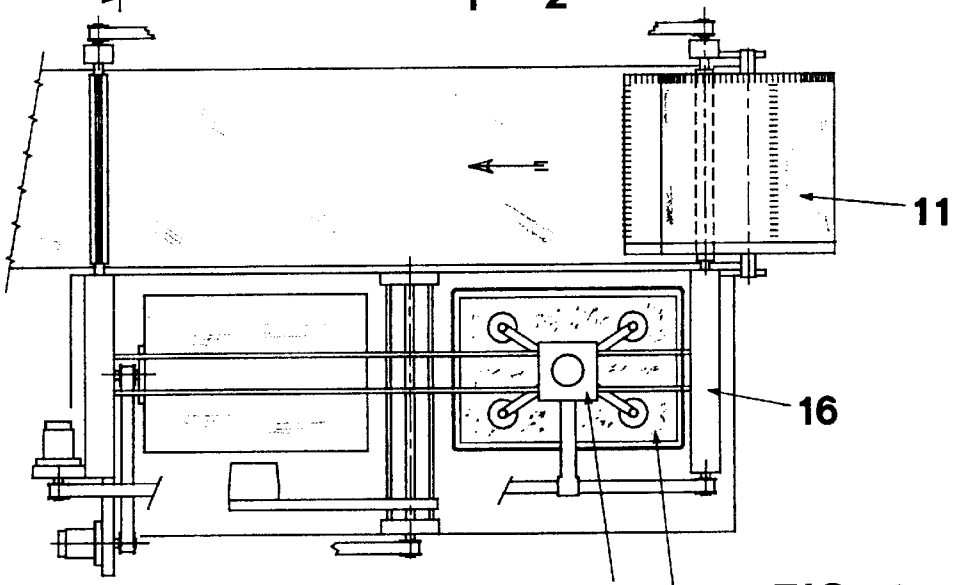
FIG. 3 schematically shows a top view of the equipment of this invention in an off-line position.

As can be seen in FIGS. 1 and 2, the equipment of this invention (defined as an automatic photopacker) is essentially made up of a storage area 1, on which the stack 2 of photos 3, stacked with the image facing upwards, and suction-cup group 4 which has the task of taking out one photo 3 at a time from the above-mentioned stack and then placing it on the rotating shelf 5.

The rotating shelf 5 is conveniently capable of turning on its longitudinal axis 6 at least 180°, thus allowing a pair of photos 3' and 3" to be placed onto its two surfaces.

A pusher 7 slides along the rotating shelf 5 and inserts each pair of photos 3' and 3" into two identical pockets which form the envelope 9.

The series of envelopes 9, 9', and 9" is formed as a continuous band 10, possibly wound up in a reel 11, which moves forward intermittently along the belt 12 and is pulled along by a motorized 13 rubber roller.

At the end of the work cycle, a cutter 14 comes into action and separates the portion of the band 10 with the filled pockets 9" from the remaining part, still to be filled.

The phases for carrying out the automatic insertion process with the photopacker equipment of this invention are illustrated in FIGS. 3 to 14.

At the beginning of the cycle (see FIGS. 3, 4 and 5), the rotating shelf 5 (FIG. 1), hinged to the support 15, is found in a horizontal position, while the suction-cup group 4 takes the first photo 3 from the stack, and the band 10 wound on the reel and held by the support 16, starts to unwind onto the belt 12 under the action of the roller 13, which is put into motion by a motor not shown in the diagram.

Subsequently, the suction-cup group 4 holding the photo 3 transfers said photo onto the upper surface of the rotating shelf 5.

Figure 8:
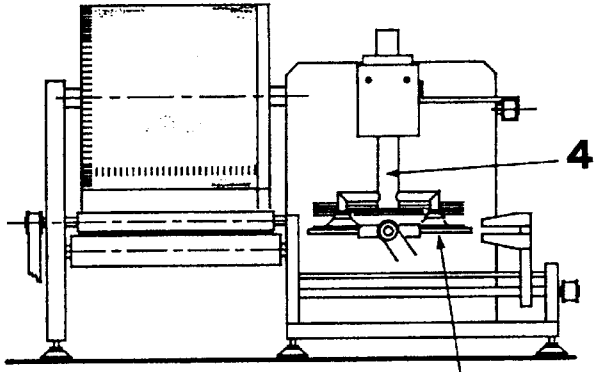
FIG. 8 is a cross-sectional view of the equipment of FIG. 6, according to the line VIII—VIII of FIG. 7.
Figure 7:
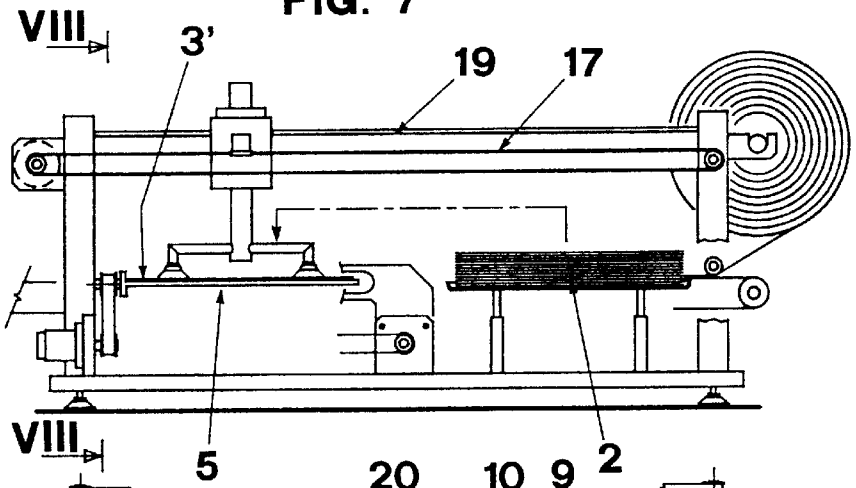
FIG. 7 is a side view of the equipment of FIG. 6.
Figure 6:
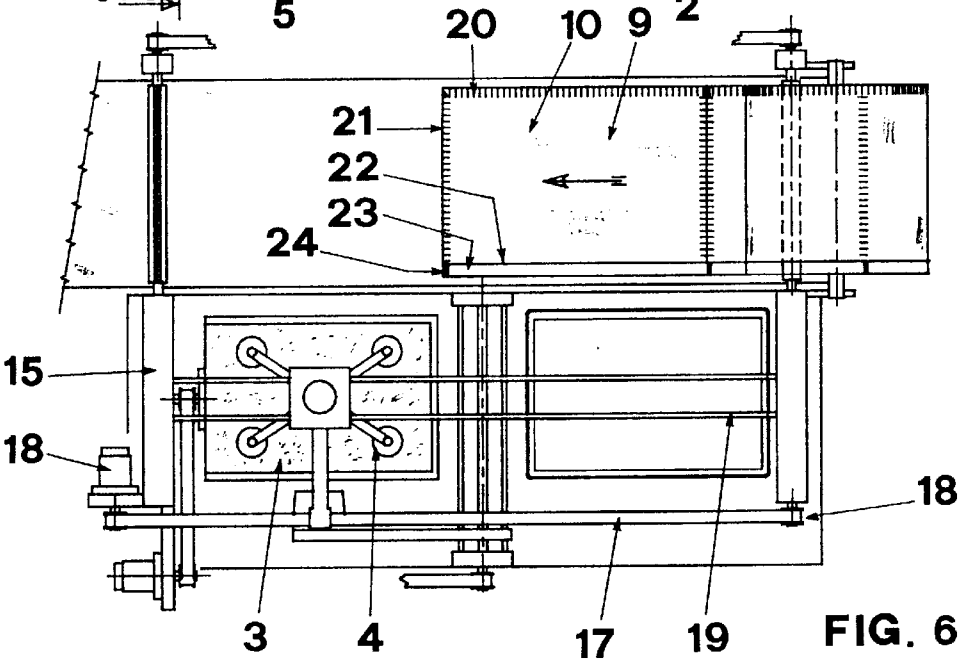
FIG. 6 schematically shows a top view of the equipment of this invention, during the positioning phase of the first of the two photos for the pair to be formed.

The suction-cup group 4 moves by under the action of the belt 17, held between two return pinions 18, one of which is motorized and kept on track by longitudinal joint pins or rails 19 connected with the supports 15 and 16 (see FIGS. 6, 7 and 8).

The envelopes 9 are normally made of two overlaying transparent sheets, joined together along one edge 20 and containing a series of crossing, equally-spaced welded seams 21 in such a way as to define a series of pockets with three closed edges and a fourth one, facing the equipment, possessing two separable edges for inserting the pair of photos.

Alternatively, a single sheet, folded lengthwise (single-fold film) with two overlaying edges 22 having different lengths, can be used.

The equipment of this invention is also characterized by the fact that each envelope 9 is made of two overlaying pockets, one for each photo of the pair, obtained by inserting between the two transparent sheets a middle sheet 23 which is quite rigid and having a protrusion on which markings 24 are stamped which, when read by optical scanners, regulate the intermittent movement of the above-mentioned band.

With the insertion of this middle sheet, the two photos 3', 3" do not touch each other, and this allows for quicker and easier insertion as described below.

Figure 11:
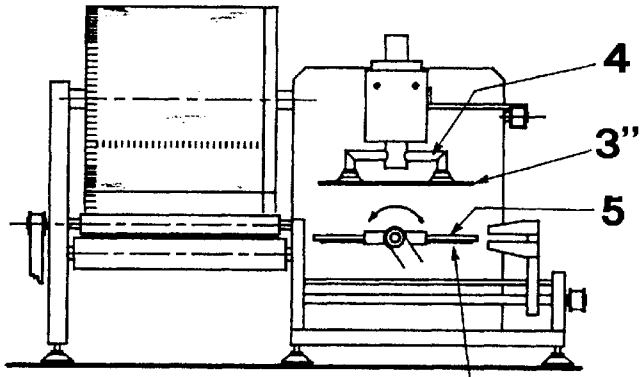
FIG. 11 is a cross-sectional view of the equipment of FIG. 9, according to the line XI—XI of FIG. 10.
Figure 10:
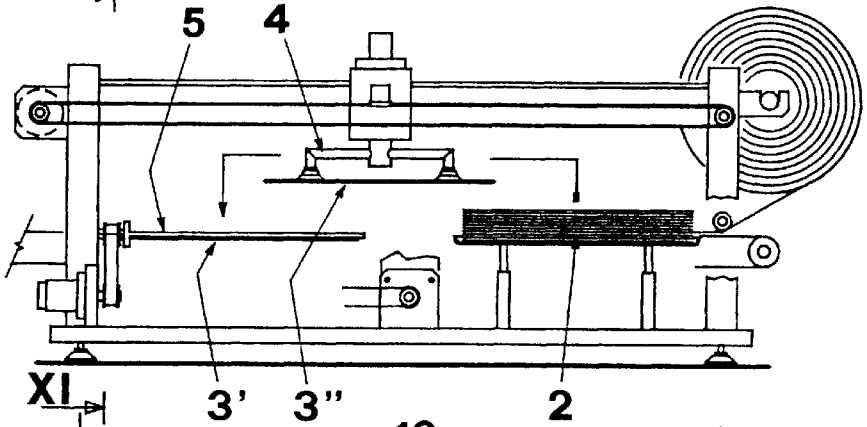
FIG. 10 is a side view of the equipment of FIG. 9.
Figure 9:
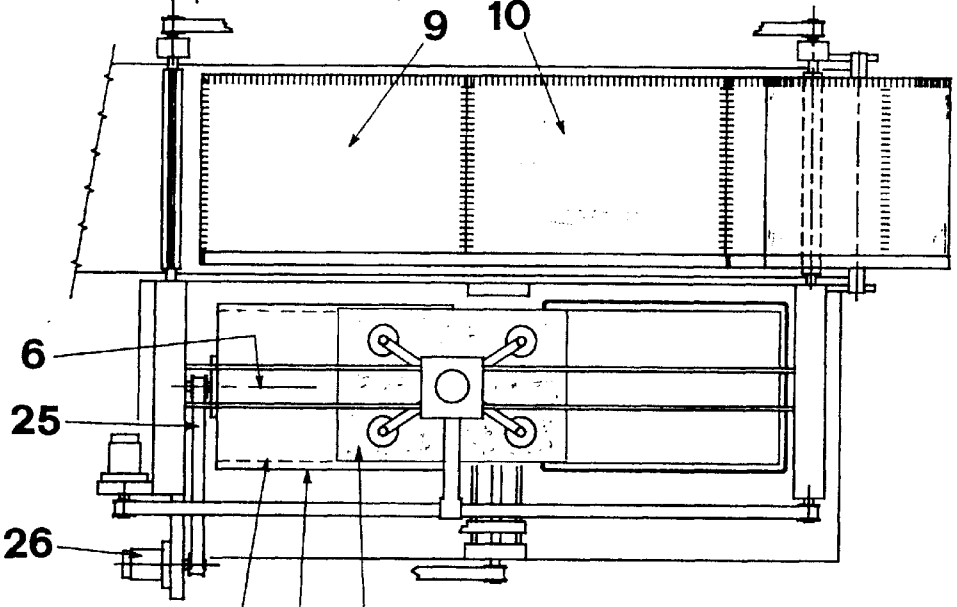
FIG. 9 schematically shows a top view of the equipment of this invention, during the positioning phase of the second photo for the pair to be formed.
Figure 14:
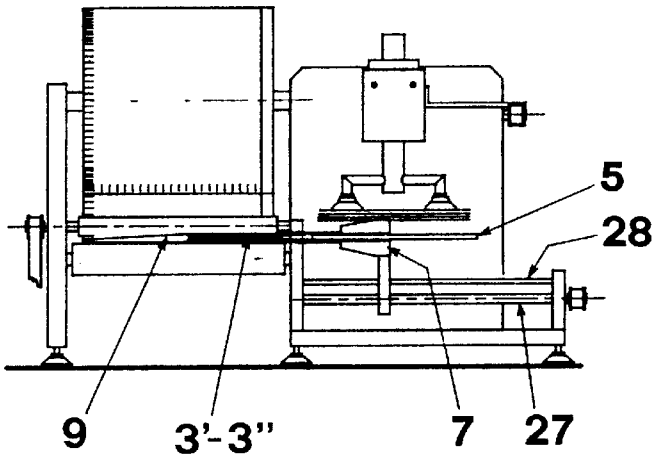
FIG. 14 is a cross-sectional view according to line XIV—XIV of FIG. 13.
Figure 15:
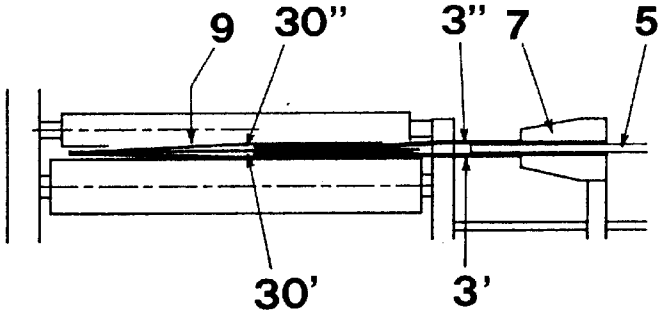
FIG. 15 illustrates a detailed enlargement of the insertion area of FIG. 14.
Figure 13:
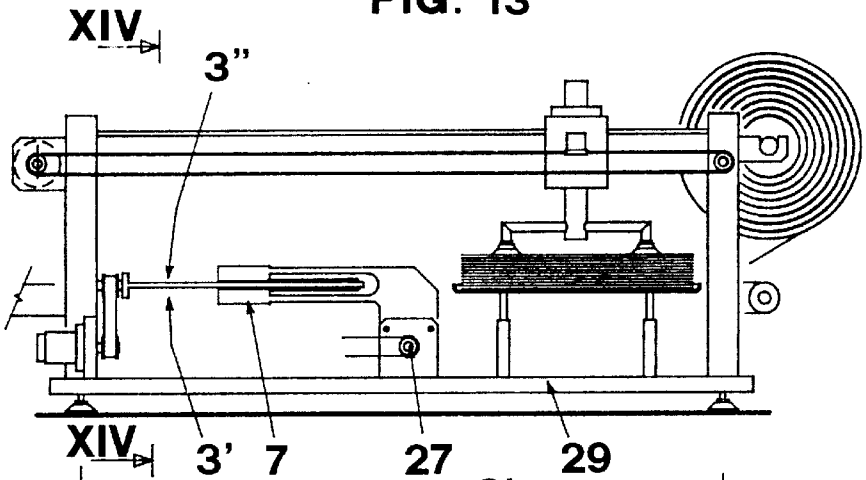
FIG. 13 is a side view of the equipment of FIG. 12.
Figure 12:
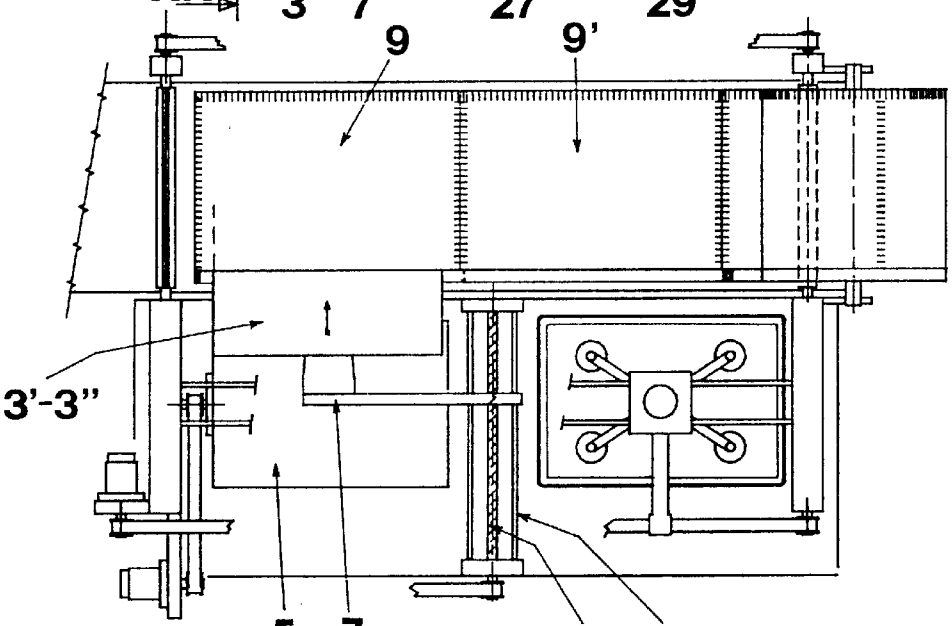
FIG. 12 schematically shows a top view of the equipment of this invention, during the introduction phase of the pair of photos into the corresponding pockets which make up the complete envelope.

After the positioning of the photo 3', the rotating shelf 5 rotates 180° in order to turn the above-mentioned photo downwards and present the free surface upwards (see FIGS. 9, 10 and 11).

Next, the suction-cup group 4 takes the following photo 3" from the stack 2 and places it on the above-mentioned free surface.

The rotation of the rotating shelf 5 is carried out by means of the belt 25 and the motor 26 connected with the support 15.

At the same time, the band 10 is stopped, positioning the open edges of the envelope 9 in line with the rotating shelf 5.

Finally, the pusher 7, sliding simultaneously over both surfaces of the rotating shelf 5, slides from said shelf the two photos 3' and 3" which, in pairs, back-to-back and not touching each other, are inserted simultaneously into each respective pocket 30' and 30" which makes up the envelope 9 (see FIGS. 12–15).

The movement of the pusher 7 is carried out by dovetailing on the threaded shaft 27, put in motion by the motor not shown in the drawing, and is guided on the joint pin or rails 28.

The photopacker further includes a system for anchoring photos 3 on rotating shelf 5 so as to hold the photos on the surface thereof during rotation of the shelf by 180°. Any suitable system for accomplishing this anchoring feature is acceptable, such as flexible edges or strips applied to the surfaces of the rotating shelf or microchannels of pneumatic suction formed within the body of the rotating shelf.

The entire photopacker, placed on the base plate 29, is equipped with a control panel where the user sets the number of photos to insert, the production speed, the cutting frequency and other working parameters, as well as the equipment and the microprocessors which regulate the entire production cycle, which are not themselves the object of this invention.

It should be stressed that the photopacker of this invention has been described with an operative sequence of separate and subsequent phases only for explanation simplicity, while, in reality, the different phases overlap in order to reduce to a minimum the average time necessary for each insertion cycle.

In conclusion, it is obviously possible to design other types of arrangements for the structures which make up the photopacker and still within the scope of the present invention.

What is claimed is:

1. An automatic photopacker for inserting into a series of envelopes (9, 9', 9"), said envelopes having overlaying independent pockets (30', 30"), a pair of photos which are positioned back-to-back, said envelopes being lined up as a continuous band (10), said automatic photopacker comprising:

a) a storage area (1) containing at least one stack (2) of photos (3) with their images being upwardly;

b) suction cup group (4) for removing one photo at a time from said stack (2) of photos (3) in said storage area (1);

c) a rotating shelf (5) having first and second surfaces upon which are placed the photos removed from said stack (2) by said suction cup group (4), said rotating shelf being adapted to rotate about a longitudinal axis (6) by 180° so that said first and second surfaces alternatingly face upwardly to receive from said suction cup group (4) a first photo (3') and a second photo (3") to form a pair of photos (3', 3") arranged back-to-back, free of contact with each other and each turned 180° with respect to the other;

d) anchoring means to hold said first photo on said rotating shelf;

e) a pusher (7) for sliding said pair of photos (3', 3") simultaneously from said shelf (5), without altering the relative position of said pair of photos into said independent pockets (30', 30"), one for each photo, of said envelope;

f) a reel (11), a belt (12) and a motorized roller (13), said band (10) being wound up in said reel (11), said reel moving intermittently along said belt (12), said belt being pulled by said motorized roller (13).

2. The photopacker according to claim 1 which includes a second belt (17), two return pinions (18), vertical supports (15,16) and longitudinal joint pins (19), said suction-cup group (4) transferring said photos by means of said belt (17) stretched onto said two return pinions (18), at least one of said pinions being motorized and being connected with said vertical supports (15, 16), and being guided by said longitudinal joint pins (19).

3. The photopacker according to claim 2 which includes a cutter (14), said cutter being placed across said band (10), said cutter separating the filled envelopes from the empty ones, each of said separate envelopes being stacked in order to form an album in which the photos are displayed in the same order as they were developed from the roll of photographic film.

4. The photopacker according to claim 3 which includes a third belt (25) and a second motor (26), said motor being connected to said support (15), said rotating shelf (5) intermittently rotating under the action of said third belt (25) and said motor (26).

5. The photopacker according to claim 4 which additionally includes a threaded shaft (27) and longitudinal joint pins (28), said pusher running along said two surfaces of said rotating shelf (5) simultaneously and is moved in a straight line due to the rotation of said threaded shaft (27) and is guided by said longitudinal joint pins (28).

6. A process for automatic insertion of photos arranged in pairs back-to-back, free of direct contact with each other and with the images mutually turned 180°, into envelopes equipped with two overlaying and independent pockets, formed in a continuous band, to be used with a photopacker according to claim 1 which consists of the steps of:

1) placing a vertical stack of photos into a storage area with the back turned downwardly;

2) removing the first photo and placing said first photo on the upper surface of a rotating shelf by means of a suction cup group;

3) applying anchoring means to hold said first photo on said upper surface of said rotating shelf;

4) rotating said rotating shelf of 180° whereby said first photo is carried underneath said shelf with the image turned 180° and said rotating shelf shows a second surface upwardly;

5) removing from said stack a second photo and placing said second photo on said second surface of said rotating shelf;

6) intermittently moving a band in order to position said two pockets with the open edges in correspondence with said rotating shelf;

7) moving a pusher, said pusher sliding said pair of photos simultaneously from said rotating shelf and inserting them into said pockets, keeping the same relative positioning of the photos;

8) advancing said band at least one unit;

9) and separating the filled envelope from the following empty one.

* * * * *